US005249443A

United States Patent [19]

Anderson

[11] Patent Number: 5,249,443

[45] Date of Patent: Oct. 5, 1993

[54] FRONT-INSTALLED DUAL CAM LOCK WITH PIVOTING CAMS

[75] Inventor: Victor R. Anderson, Trumbull, Conn.

[73] Assignee: Loctec Corporation, Newton, Conn.

[21] Appl. No.: 941,911

[22] Filed: Sep. 8, 1992

[51] Int. Cl.[5] ..... E05B 9/08

[52] U.S. Cl. ..... 70/370; 70/78; 70/83; 70/123; 70/466

[58] Field of Search ..... 70/78-83, 70/380, 123, 84, 370, 466

[56] References Cited

U.S. PATENT DOCUMENTS 1,233,733 7/1917 Voight ..... 70/380
1,243,016 10/1917 Voight ..... 70/380
2,938,373 5/1960 Gray et al. ..... 70/370

*Primary Examiner*—Peter M. Cuomo
*Assistant Examiner*—Darnell M. Boucher
*Attorney, Agent, or Firm*—Haynes N. Johnson

[57] ABSTRACT

A pre-assembled front-loading lock having a first cam fixedly mounted on its shaft, a second cam parallel to the first cam and rotatably mounted on the shaft, and a locking member fixedly mounted on the shaft to secure the second cam against rotation with respect to the first cam when the second cam has been rotated about the shaft a predetermined amount. As a result, the lock with the cams can be pressed through a panel opening and the cams thereafter be readily moved into operating position. A stop is provided on the locking member to prevent the second cam from being rotated in the wrong direction.

14 Claims, 3 Drawing Sheets

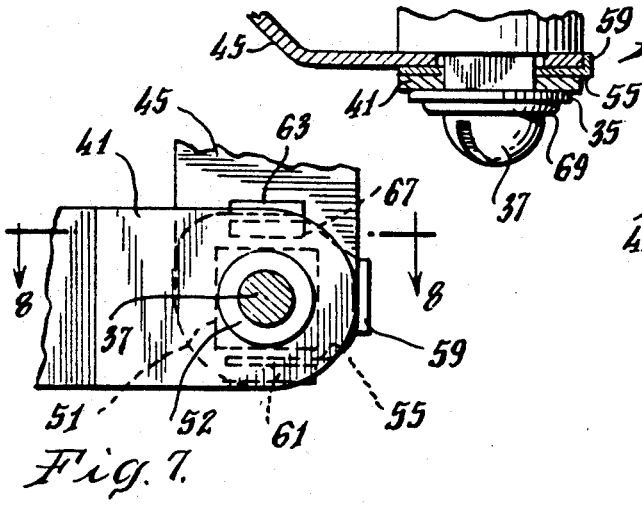
Fig. 7.
Fig. 8.
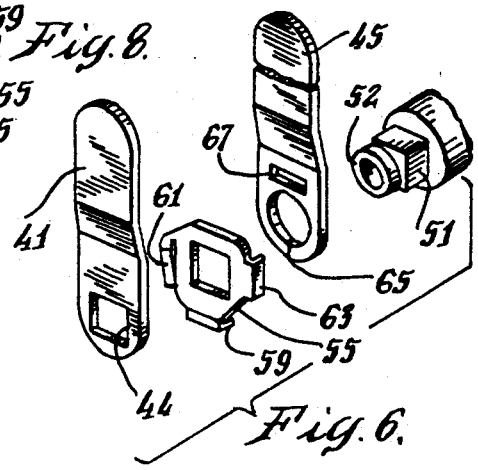
Fig. 6.
Fig. 9.
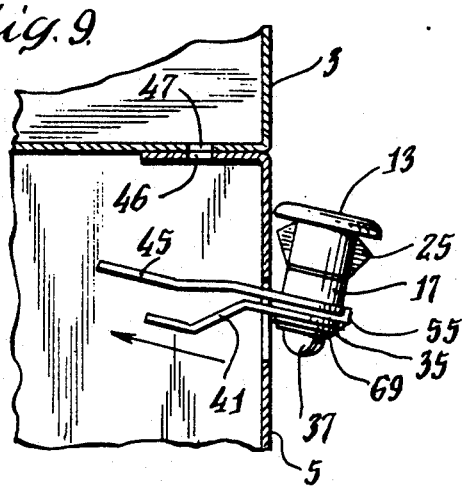
Fig. 10.
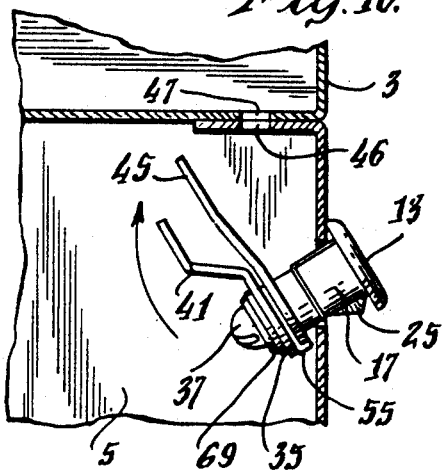
Fig. 11.
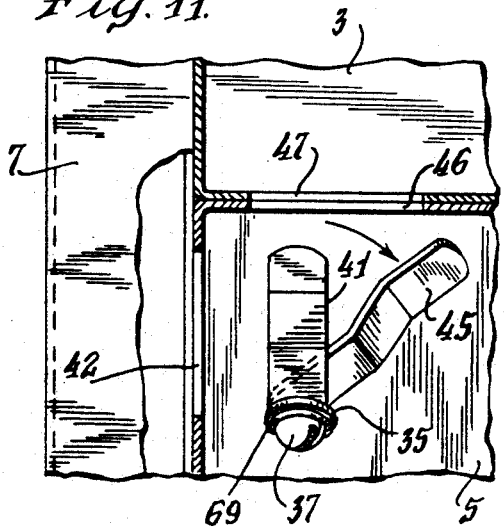
Fig. 12.
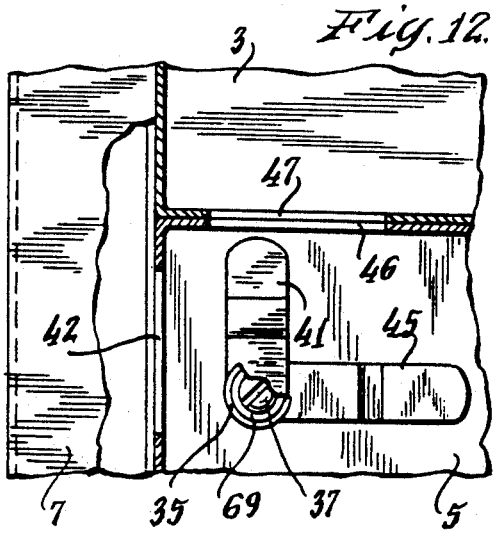

FRONT-INSTALLED DUAL CAM LOCK WITH PIVOTING CAMS

FIELD OF THE INVENTION

This invention relates to the field of dual cam locks used for filing cabinets and other end use applications, and, in particular, it relates to locks which can be installed from the front of the panel with a minimum of reaching behind the panel.

BACKGROUND OF THE INVENTION

In the past, cam locks have been installed in file cabinets and other metal cabinets from the front. A spring retaining clip carried by the lock had two spring ears flaring outwardly toward the panel. The lock would be pressed through an opening in the drawer panel, and after the lock was fully in position, with its face plate pressing against the outer surface of the panel, the ears snapped out, pressing against the inner surface of the panel to hold the lock in place.

If the lock was single cam, the cam could be pre-installed on the lock and slipped through the hole at the same time. If two cams were required, one cam for each of two drawers, an L-shaped piece (two perpendicular cams) was used. This piece could not fit through the panel opening and, so, would have to be attached from the rear with a Keps nut (combined nut and lock-washer) or a Sems screw after the lock was in place. This meant that the lock could not be fully pre-assembled. This system, then, required considerable work behind the panel, was relatively expensive, and often resulted in cut fingers, in addition to low employee morale. Since cost of manufacture is critical when one is making low-end file cabinets, the ability to pre-assemble a lock, including its cams, becomes important.

BRIEF SUMMARY OF THE INVENTION

I have discovered, however, that it is possible to have two cams and still pre-assemble the entire unit before installation. This is done by initially making the unit with the cams overlapping (so they act as a single cam during installation), and making the second cam such that it can, after installation, be rotated ninety degrees relative to the first cam and lock itself in position. Then, the two-cam lock can be installed from the front, and the only work that needs to be done inside the unit after installation of the lock is a simple rotation of the second cam until it snaps into position.

DESCRIPTION OF THE DRAWINGS

FIG. 6 is an exploded view of my two-cam construction, shown with the two cams parallel and overlapping as they would be when the lock is being installed FIG. 7 is an enlarged detail showing how the two cams interlock after the inner, long cam has been rotated ninety degrees to the left (counterclockwise as viewed).

FIG. 8 is a section taken on line 8—8 of FIG. 7.

FIGS. 9, 10, and 11 show the steps of installing the lock. FIGS. 9 and 10 are vertical sections showing the cams and the lock being inserted through the panel opening; and FIG. 11 is a rear elevation showing one cam being rotated with respect to the other so that the two cams are perpendicular to one another.

FIG. 12 is a rear elevation showing the two cams in their final engaged, L-shaped position, perpendicular to one another, the file cabinet being unlocked.

DETAILED DESCRIPTION OF THE INVENTION

Figure 1:
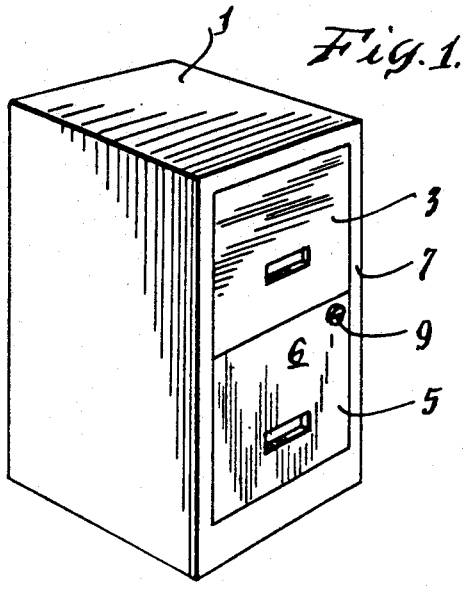
FIG. 1 is a perspective view of a filing cabinet showing a typical installation.
Figure 3:
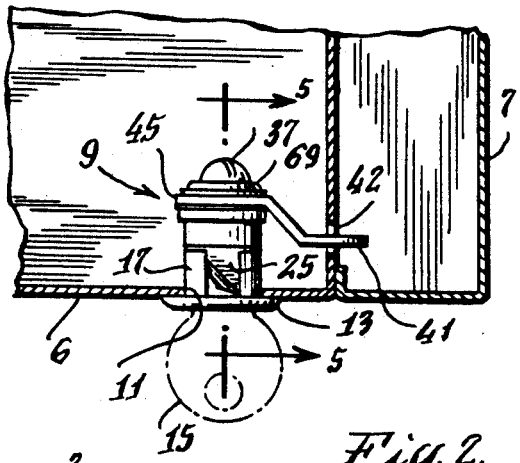
FIG. 3 is a section taken on line 3—3 of FIG. 2 showing locking of the lower drawer.
Figure 4:
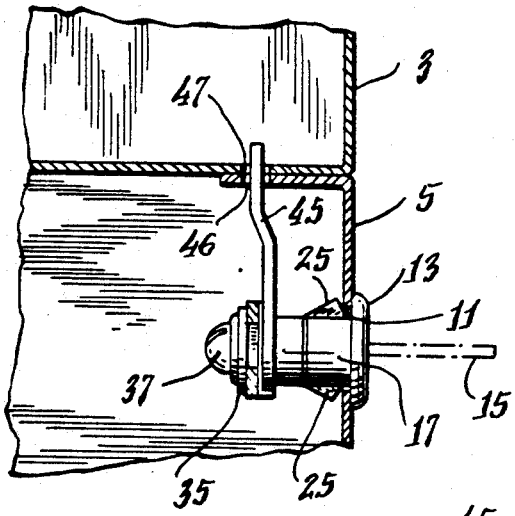
FIG. 4 is a section taken on line 4—4 of FIG. 2 showing locking of the upper drawer.
Figure 2:
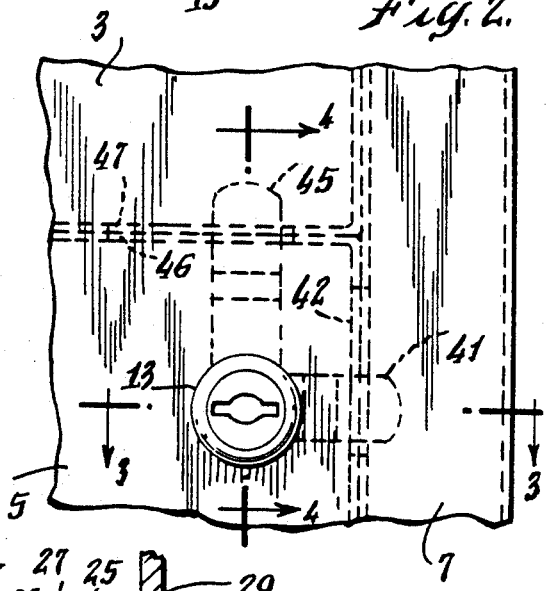
FIG. 2 is a front elevation showing the installed lock in its locked position. The lock has a L-lever which serves to lock two drawers.
Figure 5:
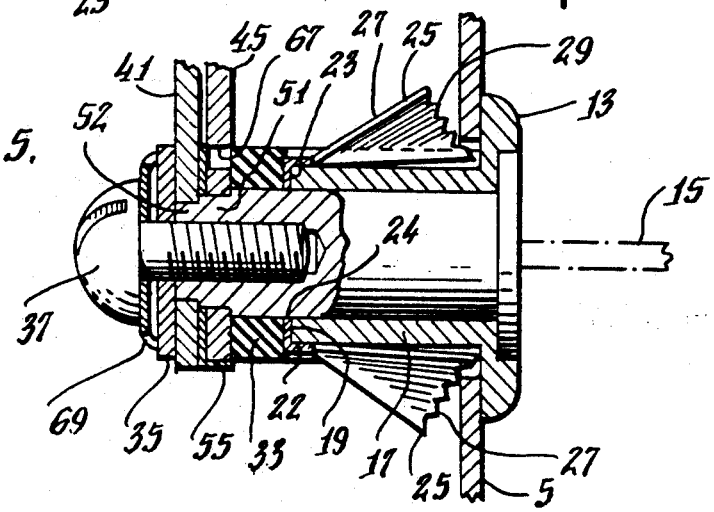
FIG. 5 is a section taken on line 5—5 of FIG. 3 showing the retaining spring securing the lock in place.

Cam locks are often used on file cabinets 1 having, say, two drawers, an upper drawer 3 and a lower drawer 5, with side members 7. The lock 9 itself is often installed in the upper right corner of the face 6 of the lower drawer 5.

Face 6 has an opening 11 to receive lock 9. The opening normally has a double-D shape (i.e., round with opposite sides flattened) so that the lock can not rotate in the opening. The lock itself has an outer face plate 13, wider than the opening, which fits against the outer surface of face 6. It has a barrel 17 with a complementary double-D cross-section which passes through opening 11. The barrel is narrowed at shoulder 19 to the width of rotating shaft 20.

A retaining spring is made of spring steel and includes a washer-like planar base 23 with a rim 22 and an opening 24 in it so that it can fit about shaft 20. The outer periphery of rim 22 is preferably smaller than opening 11, i.e., so dimensioned that, when mounted on a lock, it can pass through the opening. Two integral legs 25, made of the same piece of spring steel, extend from the base at an angle such that they extend slightly away from the axis of the shaft 20 (as they did in the earlier type of retaining spring). The two legs 25 are usually identical, and each leg has sides of different lengths to provide an angular outer end 27 for the leg. The shorter leg is bent so that it extends farther outwardly (away from the axis). The lock, when mounted, is secured in position by having the portions of face 6 which form the edges or periphery 12 of opening 11 held firmly between lock face plate 13 and the angular ends 27 of legs 25. Legs 25 are dimensioned such that their angular ends 27 will abut the edges of opening 11; and the legs have their longer sides innermost.

The retaining spring is fitted about shaft 20 and against shoulder 19, with its base 23 transverse to the axis of the shaft. Alternatively, in order to adjust the final position of the ends 27 of legs 25, one or more washers or spacers 33 and 35 may fit about shaft 20 between spring base 23 and shoulder 19 or elsewhere on the shaft.

I have found that a satisfactory retaining spring can be made of spring steel which is 0.5 mm thick with the sides of each leg being 8.8 mm (0.340") and 10.3 mm (0.400"), with the shorter side of each leg being bent slightly outwardly, i.e., away from the other leg. The differences between the 0.340" and 0.400" dimensions will allow and accommodate different double-D hole material thickness to a small degree, such as ±0.040"". Beyond this range, spacers can be used for adjustments.

This retaining spring structure is the subject of another patent application being filed by me concurrently.

If a lock has a single cam, the lock and cam can both be installed from the front through the panel opening 11 in the face of the cabinet. Thus, the lock and cam can be pre-assembled with the resulting economy. If, however, two perpendicular cams are being used, they will not fit through the opening, and, so, cannot be pre-assembled. In such case, the past practice has been to have the two cams made up as a single L-shaped piece which is installed from the back after the lock itself has been mounted.

With my invention, it is possible to have two cams on a lock and still pre-assemble the entire unit before installation. This is done by initially making the unit with the cams overlapping (so they act as a single cam during installation), and making the second cam such that it can, after installation, be rotated ninety degrees relative to the first cam and lock itself in position. Then, the two-cam lock can be installed from the front, and the only work that needs to be done inside the unit after installation of the lock is a simple rotation of the second cam into position.

The structure I use to provide for the two cams is best seen in FIGS. 6 to 8. The inner end of shaft 20 carries a square projection 51 and then a round projection 52. The inner, long cam 45 has a round opening 65 in it which just fits over projection 51, so that it can rotate relative to projection 51. A locking member 55 with a square opening 57, just fitting projection 51 and so preventing rotation, is also fitted over square projection 51. The length of square projection 51 is equal to the combined thicknesses of cam 41, cam 45, and locking member 55. Short cam 45 has a square opening 44 which just fits over square projection 52, and so can not rotate relative to projection 51. It is held in place by screw 37 (FIG. 8) or by spinning round projection 52.

Locking member 55 includes a spacing flange 59 projecting in an axial direction toward long cam 45. This spaces cam 45 from the body of locking member 55 when the lock is pre-assembled and the two cams are parallel (before installation) as shown in Fig. 6. Member 55 also has a spring arm 61 which is formed by partially severing a portion of member 55 and bending it in an axial direction toward long cam 45. Spring arm 61 is ninety degrees counterclockwise of spacing flange 59, as seen in FIG. 6, and is bent with the bottom of it in the direction away from the viewer in that figure. This spring arm also serves to hold cam 45 away from locking member 55 when the two cams are parallel, as in Fig. 6.

Long cam 45 has a locking slot 67 so located that, when the cam 45 is rotated to be perpendicular to short cam 41, spring arm 61 will snap into slot 67, locking long cam 45 in position. It cannot thereafter be returned to its original position.

Stop member 63 is a flange located on locking member 55 ninety degrees clockwise of long cam 45, as seen in FIG. 6. It projects in the same axial direction as spacing flange 59(toward shaft 20), but for a greater distance. While spacing flange 59 is under long cam 45, keeping the cam removed from the locking member, stop member 63 is beside cam 45, to prevent accidental rotation of cam 45 in the wrong direction when the lock is being installed.

Installation of a lock with two cams is done in substantially the same manner as has been done formerly with a single cam. The two cams 41 and 45 (parallel to one another as pre-assembled) and barrel 17 of lock 9 are inserted through opening 11 in face 6, as shown in FIGS. 9 and 10, until legs 25 of retaining spring 21 snap in place. The installer then reaches in back and swings long cam 45 ninety degrees until spring arm 61 snaps into locking slot 67. The installation is then complete, and has not involved actually attaching the cams from the rear. As can be seen, stop member 63 prevents the worker from accidentally turning the cam 45 in the wrong direction. Both cams are now fixed against relative rotation relative to the shaft.

Figure 13:
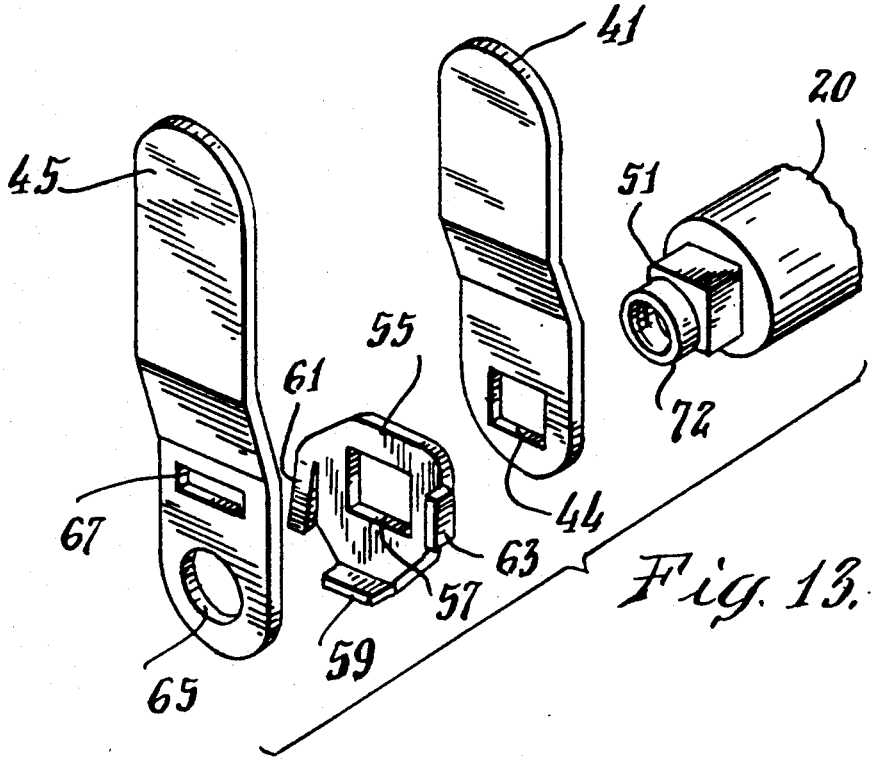
FIG. 13 is an exploded view of a modification of my two-cam construction, similar to FIG. 6.

A similar structure used to provide for the two cams to be parallel during installation, followed by rotating one to a new position, is seen in FIG. 13. The inner end of shaft 20 carries a square projection 51 and then a round projection or pivot 72. The inner, short cam 41 has a square opening 44 in it which fits over projection 51, and, so, the short cam will rotate as shaft 20 is turned. A locking member 55 with a similar square opening 57 is also fitted over square projection 51. The length of square projection 51 is equal to the combined thicknesses of cam 41 and locking member 55. Long cam 45 has a round opening 65, rotatably fits over pivot 72, and is held in place by screw 37 or otherwise.

Locking member 55 includes a spacing flange 59 projecting in an axial direction toward long cam 45. This spaces cam 45 from the body of locking member 55 when the lock is pre-assembled and the two cams are parallel (before installation) as shown in Fig. 13. Member 55 also has a spring arm 61 which is formed by partially severing a portion of member 55 and bending it in an axial direction toward long cam 45. Spring arm 61 is ninety degrees counterclockwise of spacing flange 59, as seen in FIG. 13, and is bent with the bottom of it in the direction of the viewer in that figure. This spring arm also serves to hold cam 45 away from locking member 55 when the two cams are parallel, as in FIG. 13.

Long cam 45 again has a locking slot 67 so located that, when the cam 45 is rotated to be perpendicular to short cam 41, spring arm 61 will snap into slot 67, locking long cam 45 in position. It cannot thereafter be returned to its original position.

Stop member 63 is a flange located on locking member 55 ninety degrees counterclockwise of spacing flange 59, as seen in FIG. 6. It projects in the same axial direction as spacing flange 59(toward shaft 20), but for a greater distance. While spacing flange 59 is under long cam 45, keeping the cam removed from the locking member, stop member 63 is beside cam 45, to prevent accidental rotation of cam 45 in the wrong direction when the lock is being installed.

Thus, it can be seen that my system allows front installation of dual cam locks with a minimum of work behind the panel. This system saves labor and risk of injury to the worker. Since cost of manufacture is critical when one is making low-end file cabinets, this ability to pre-assemble a lock with two cams becomes important.

I claim:

1. A pre-assembled lock adapted for front-mounting through an opening in a panel, said lock including a face plate, a barrel extending transversely therefrom, and a shaft extending from said barrel, a first cam fixedly mounted on said shaft, a second cam pivotally mounted on said shaft, said second cam being substantially parallel to said first cam, and locking means for locking said second cam against pivoting relative to said first cam after said second cam has been pivoted a predetermined distance about said shaft to its operating position.

whereby said lock with said cams can be pressed through a panel opening and said cams thereafter be readily placed in operating positions fixed relative to each other.

2. A pre-assembled lock as set forth in claim 1 in which said locking means is a locking member non-rotatably mounted on said shaft and abutting said second cam.

3. A pre-assembled lock as set forth in claim 2 including interengagement means operable between said locking member and said second cam.

4. A pre-assembled lock as set forth in claim 1 in which a portion of said shaft has a square cross-section and said first cam and said locking means have openings complementary to said square cross-section which fit about said square cross-section, whereby said first cam and said locking means are fixed against pivoting on said shaft.

5. In a dual-cam lock made for front installation through an opening in a panel, the lock including a face plate, a barrel extending from the face plate, and a shaft extending from the barrel, that improvement including a first cam fixedly mounted on said shaft for rotation therewith, a second cam mounted on said shaft and rotatable therewith, said second cam being substantially parallel to said first cam, and locking means which lock said second cam against further rotation relative to said shaft and said first cam, after said second cam has been rotated a predetermined angle from said first cam to its operating position, whereby said lock can be passed through said opening in a panel and said second cam thereafter moved to, and locked into, operating position.

6. The improvement set forth in claim 5 in which said locking means is a locking member non-rotatably mounted on said shaft and abutting said second cam.

7. The improvement set forth in claim 6 including interengagement means operable between said locking member and said second cam.

8. The improvement set forth in claim 5 in which a portion of said shaft has a square cross-section and said first cam and said locking means have openings complementary to said square cross-section which fit about said square cross-section, whereby said first cam and said locking means are fixed against pivoting on said shaft.

9. A pre-assembled lock adapted for front-mounting through an opening in a panel, said lock including a face plate, a barrel extending transversely therefrom, and a shaft extending from said barrel, a first cam fixedly mounted on said shaft, a second cam rotatably mounted on said shaft, said second cam being substantially parallel to said first cam, and locking member for locking said second cam against rotation relative to said first cam after said second cam has been rotated a predetermined amount about said shaft, said locking member being non-rotatably mounted on said shaft and abutting said second cam, interengagement means operable between said locking member and said second cam, said interengagement means including a projecting spring on said locking member and a complementary spring-engaging slot on said second cam, whereby said lock with said cams can be pressed through a panel opening and said cams thereafter be readily placed in operating positions.

10. A pre-assembled lock as set forth in claim 9 including a stop on said locking member positioned to prevent inadvertent rotation of said second cam in an undesired direction.

11. A pre-assembled lock adapted for front-mounting through an opening in a panel, said lock including a face plate, a barrel extending transversely therefrom, and a shaft extending from said barrel, a first cam fixedly mounted on said shaft, a second cam pivotally mounted on said shaft, said second cam being substantially parallel to said first cam, locking means for locking said second cam against pivoting relative to said first cam after said second cam has been pivoted a predetermined distance about said shaft, said locking means being a locking member non-rotatably mounted on said shaft and abutting said second cam interengagement means operable between said locking member and said second cam, said interengagement means including a projecting spring on said locking member and a complementary spring-engaging slot on said second cam, whereby said lock with said cams can be pressed through a panel opening and said cams thereafter be readily placed in operating positions.

12. A pre-assembled lock adapted for front-mounting through an opening in a panel, said lock including a face plate, a barrel extending transversely therefrom, and a shaft extending from said barrel, a first cam fixedly mounted on said shaft, a second cam pivotally mounted on said shaft, said second cam being substantially parallel to said first cam, locking means for locking said second cam against pivoting relative to said first cam after said second cam has been pivoted a predetermined distance about said shaft, said locking means being a locking member non-rotatably mounted on said shaft and abutting said second cam, and a stop on said locking member positioned to prevent inadvertent pivoting of said second cam in an undesired direction.

whereby said lock with said cams can be pressed through a panel opening and said cams thereafter be readily placed in operating positions.

13. In a dual-cam lock made for front installation through an opening in a panel, the lock including a face plate, a barrel extending from the face plate, and a shaft extending from the barrel, that improvement including a first cam fixedly mounted on said shaft for rotation therewith, a second cam mounted on said shaft and rotatable therewith, said second cam being substantially parallel to said first cam, and locking means which lock said second cam against further rotation relative to said shaft after said second cam has been rotated about said shaft to a predetermined angle from said first cam, said locking means being a locking member non-rotatably mounted on said shaft and abutting said second cam, and interengagement means operable between said locking member and said second cam, said interengagement means including a projecting spring on said locking member and a complementary spring-engaging slot on said second cam, whereby said lock can be passed through said opening in a panel and said second cam thereafter moved to operating position.

14. In a dual-cam lock made for front installation through an opening in a panel, the lock including a face plate, a barrel extending from the face plate, and a shaft extending from the barrel, that improvement including a first cam fixedly mounted on said shaft for rotation therewith, a second cam mounted on said shaft and rotatable therewith, said second cam being substantially parallel to said first cam, and locking means which lock and second cam against further rotation relative to said shaft after said second cam has been rotated about said shaft to a predetermined angle from said first cam, said locking means being a locking member non-rotatably mounted on said shaft and abutting said second cam, and a stop on said locking member positioned to prevent inadvertent rotation of said second cam in an undesired direction, whereby said lock can be passed through said opening in a panel and said second cam thereafter moved to operating position.

* * * * *